US006488170B1

(12) United States Patent
Johnson

(10) Patent No.: US 6,488,170 B1
(45) Date of Patent: Dec. 3, 2002

(54) DISPOSABLE, ROLLED RIM CONTAINER AND DOME-SHAPED COVER

(75) Inventor: Timothy C. Johnson, Boston, MA (US)

(73) Assignee: Tim Johnson Design, Inc., Boston, MA (US)

( * ) Notice: Subject to any disclaimer, the term of this patent is extended or adjusted under 35 U.S.C. 154(b) by 42 days.

(21) Appl. No.: 09/715,715

(22) Filed: Nov. 17, 2000

(51) Int. Cl.[7] ..... A47G 19/22; B65D 41/18

(52) U.S. Cl. ..... 220/254.2; 220/254.3; 220/782; 220/714

(58) Field of Search ..... 220/254, 266, 220/268, 270, 712, 713, 714, 781, 782, 739, 711, 254.2, 254.3, 254.5; 206/508, 509; 229/403, 404

(56) References Cited

U.S. PATENT DOCUMENTS

| | | | | |
|---|---|---|---|---|
| 3,003,668 A | | 10/1961 | Sherlock et al. | |
| 3,048,317 A | * | 8/1962 | Cochrane et al. | 220/254 |
| 3,307,746 A | | 3/1967 | Edwards | |
| 3,557,995 A | * | 1/1971 | Mirasol et al. | 206/508 |
| 3,860,162 A | | 1/1975 | Schutz | |
| 3,927,794 A | | 12/1975 | Erdman | |
| 4,081,103 A | | 3/1978 | Zoellick | |
| 4,113,135 A | | 9/1978 | Yamazaki | |
| 4,117,950 A | * | 10/1978 | Allen | 220/782 |
| 4,138,033 A | | 2/1979 | Payne et al. | |
| 4,184,604 A | | 1/1980 | Amberg et al. | |
| 4,186,842 A | | 2/1980 | Albert | |
| 4,190,174 A | | 2/1980 | Haimowitz | |
| 4,210,256 A | | 7/1980 | Amberg et al. | |
| 4,438,865 A | | 3/1984 | Scattaregia | |
| 4,441,623 A | | 4/1984 | Antoniak | |
| 4,503,992 A | | 3/1985 | Sitko et al. | |
| 4,518,096 A | | 5/1985 | Winstead | |
| 4,561,562 A | * | 12/1985 | Trombly | 220/792 |
| 4,582,214 A | | 4/1986 | Dart et al. | |
| 4,615,459 A | | 10/1986 | Clements | |
| 4,738,373 A | | 4/1988 | DeParales | |
| 4,756,440 A | | 7/1988 | Gartner | |
| 4,898,299 A | | 2/1990 | Herbst et al. | |
| 5,469,983 A | * | 11/1995 | Yawata | 220/739 |
| 5,794,843 A | * | 8/1998 | Sanchez | 229/403 |

* cited by examiner

*Primary Examiner*—Nathan J. Newhouse
(74) *Attorney, Agent, or Firm*—Dike, Bronstein, Roberts & Cushman IP Group Edwards & Angell, LLP; George W. Neuner; George W. Hartnell, III

(57) ABSTRACT

A container and a lid for closing it are disclosed. The container has an open end, a closed end and a peripheral sidewall therebetween. The peripheral sidewall has a rolled rim at the edge thereof adjacent the open end of the container. The lid has a dome-shaped structure. A peripheral rim curl is provided for locking the lid to the rolled rim of the container to close the open end. The lid also has a central region and a plurality of arched struts extending radially between the central region and the peripheral rim curl. At least one tabular hinged drinking region is provided in the lid. The tabular hinged drinking region is structured and arranged to be depressed into the container, thereby providing at least one flow-through opening in the tabular hinged drinking region of the lid. Preferably, the depressed tabular hinged drinking region is self-locking.

35 Claims, 4 Drawing Sheets

DISPOSABLE, ROLLED RIM CONTAINER AND DOME-SHAPED COVER

FIELD OF THE INVENTION

The present invention relates to the field of disposable containers for liquids or semi-liquids, particularly to drinking cups, and more particularly to non-spilling containers with a dome-shaped cover preferably having a plurality of drink-through openings.

DESCRIPTION OF THE RELATED ART

A myriad of beverage containers with drink-through covers, or lids, are known in the art. Indeed, non-spilling beverage containers with drink-through lid have changed morning commuting habits significantly. Some of these containers have included small, tear away portions of the lid, which made stacking cups difficult; created a disposal problem with the removed tab; and, in some instances, often destroyed the integrity of the peripheral curl locking means that affixes the lid securely to the container. See, e.g., Winstead (U.S. Pat. No. 4,518,096) and Scattaregia (U.S. Pat. No. 4,438,865).

Other containers have included lids with hinged tabs that rotate generally up and outward from the drinking container, which eliminated the short term tab disposal problem, but some embodiments also destroyed the integrity of the peripheral curl locking means and, depending on the size of the hinged tab, also made stacking cups difficult. See, e.g., DeParales (U.S. Pat. No. 4,738,373).

Still other containers have lids with hinged tabs that rotate generally down and inward towards the drinking container, most of which eliminated the problem associated with destroying the integrity of peripheral curl but, here again, depending on the size of the opening, stacking cups remained difficult. See, e.g., Erdman (U.S. Pat. No. 3,927,794), Yamazaki (U.S. Pat. No. 4,113,135), Dart et al. (U.S. Pat. No. 4,582,214) and Clements (U.S. Pat. No. 4,615,459).

Further, there are other containers that have lids with depressible tabs or protrusions which, when a force is applied thereto, are progressively ruptured, thereby opening a plurality of slits through which a beverage can flow. See, e.g., Sherlock (U.S. Pat. No. 3,003,668), Edwards (U.S. Pat. No. 3,307,746) and Herbst. et al. (U.S. Pat. No. 4,898,299). Although each of these inventions and a host of others have had an overall effect of improving the design of disposable drinking containers, there remains a need for a drinking container with a drink-through lid for the new millennium.

SUMMARY OF THE INVENTION

The present invention provides a drinking container and a lid. The lid is formed from a polymer resin as a dome-shaped structure having a peripheral rim curl for locking to a container and one or more tabular hinged drinking regions through which fluid can flow when the lid is fixed to the top of a container and the region is depressed thereon. The structure of the lid preferably is formed to provide a support region having sufficient strength to hold the weight of a filled container without buckling.

Each tabular hinged drinking region comprises a substantially planar or tangentially rounded raised area extending radially from a central area, or hub, of the lid toward the periphery of the lid. Near the central area, the raised area forms a hinge with the dome-shaped lid. As the raised area extends radially, vertical sidewalls with a length increasing with the radius join the raised area with the dome-shaped lid. A vertical end wall also connects the raised end of the raised area with the dome-shaped lid. By pressing down on the hinged drinking region, the raised area is at least partially inverted with respect to the dome-shaped structure and slits are formed in the lid that permit fluid to pass through for drinking. Preferably, the depressed hinged drinking region is self-locking.

The container comprises a rolled rim or other configuration for attaching the lid thereto and a pair of tactile comfort strips for orienting the container for optimal use. Preferably, the comfort strips are diametrically opposed to one another on the container. Furthermore, preferably, the comfort strips are formed as a pair of insulating comfort strips. The, e.g., diametrically opposing, comfort strips can be the focus of the strength and mass of the container. Indeed, conventional containers typically are fabricated from a ream cup stock with a 55 to 60 pound density, i.e., 55 to 60 pounds of fiber per 1,000 square feet. By concentrating the strength and mass of the container at the comfort strips, fiber density can be reduced to about 50 or less, which can reduce the cost of materials and also can reduce the environmental impact associated with disposal of the containers.

The dome-shaped, drink-through lid that is attached to the container comprises a plurality of depressible hinged tabular regions. Thus, a depressible hinged tabular region is always positioned in a suitable position relative to the comfort strips for easy drinking. The plurality of drink-through openings enables a lid to be placed on a drinking container in any manner, ensuring that at least one drink-through opening is properly aligned with the comfort strips to provide optimal drinking conditions without having to rotate the lid to align the opening with a comfort strip. The hinged tabular region can be depressed readily with a small amount of pressure exerted, e.g., by a finger tip, to form a passage for a fluid, which permits drinking of the fluid in the container without affecting deleteriously the integrity of the peripheral curl locking rim. Thus, in a preferred embodiment, the present invention provides a drink-through lid for a disposable beverage container that can be substantially non-spillable. Preferably, the drinking container provides comfort strips to insulate the fingers and thumb of the holder from the extreme temperatures of the beverage contained therein and, more importantly, to be the focal point of the mass and strength of the container. The drink-through lid for the beverage container can be opened easily, e.g., with the index finger of the hand that is simultaneously holding the drinking container.

In preferred embodiments, lids in accord with the present invention provide a drinking container that can support one or more additional filled drinking containers for easier carrying. The lid not only makes stacking cups easier, but also can be stronger, allowing more filled cups in a single stack. An added feature can include providing a lid that can also be used as a coaster.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein.

DETAILED DESCRIPTION OF THE INVENTION INCLUDING PREFERRED EMBODIMENTS

Figure 3A:
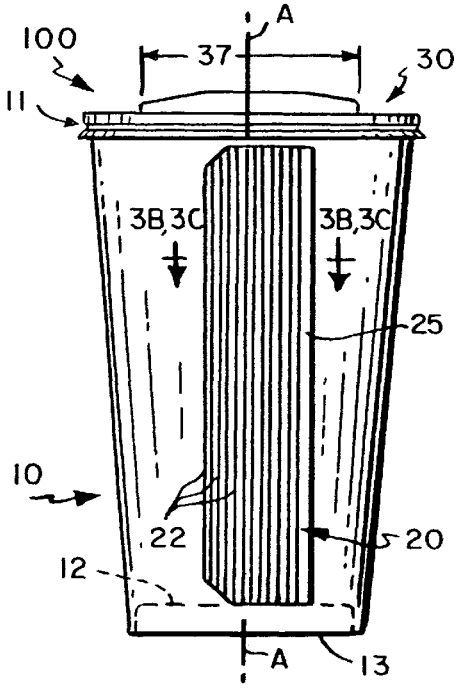
FIG. 3A is diagrammatical illustration showing an elevation view of a dome-shaped drink-through lid on a container in accord with one embodiment of the invention.

In one embodiment of the present invention (FIG. 3A), a container 100 comprises a cylindrical member 10, a pair of preferably diametrically opposed, insulated comfort strips 20, and a dome-shaped cover section 30. Preferably, each of these elements is fabricated from benign chemicals and recyclable materials, or is biodegradable, to minimize the environmental impact of the container 100. The cylindrical member 10 can be made from a single piece of material that has been wrapped around an axis A—A and affixed to itself, e.g., with polymer glues, adhesives, heat, etc., providing a watertight seal. The cylindrical member 10 has an opened top 11 and sealed bottom 12 so that fluids can be introduced into and retained by the container 100. The cylindrical member 10, further, has a rim 15 at the top 11 (FIG. 2A), which, in combination with the peripheral rim channel 34 of the dome-shaped cover 30, can seal the top 11 of the cylindrical member 10 to substantially prevent leaks or spills. The cylindrical member 10 has a base 13 for support, which, typically, extends a short distance, e.g., one quarter of an inch, below the sealed bottom 12. The cylindrical member 10 can take on practically any shape, but in a preferred embodiment, it is tapered from the top 11 toward the base 13.

Figure 3C:
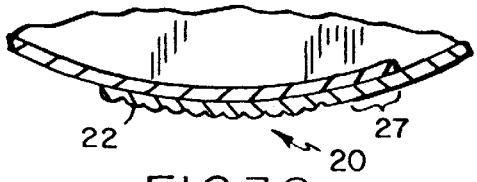
FIG. 3C is a diagrammatical illustration taken along line 3C—3C of FIG. 3A, showing an alternate embodiment of a comfort strip, wherein the comfort strip is integrally attached to the container sidewall using a sidewall seam.
Figure 3B:
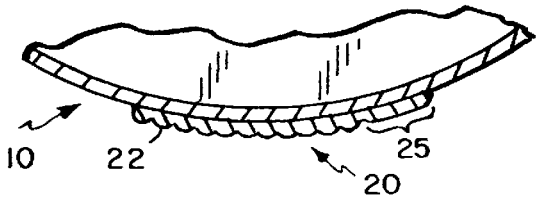
FIG. 3B is a diagrammatical illustration taken along line 3B—3B of FIG. 3A, showing an embodiment of a comfort strip wherein the comfort strip is adhesively attached to the container sidewall using a strip seam.

Affixed preferably at diametrically opposite sides of the cylindrical member 10 can be, e.g., a pair of tactile, insulating, comfort strips 20, which insulate the holder's thumb and fingers from extreme fluid temperatures and provide tactile feedback regarding the orientation of the container in one's hand (FIGS. 3B and 3C). More importantly, however, the comfort strips 20 can become the focal point of the strength and mass of the entire cylindrical member 10, permitting a reduction of the mass and strength of the rest of the cylindrical member 10, which is manifest by using a less dense, e.g., about 50 pound density or less, ream cup stock material. Indeed, at each comfort strip 20, the container 100 can be about twice as thick as it is anywhere else along the sidewall of the cylindrical member 10. Thus, when a user grabs a container 100 at the comfort strips 20, i.e., where the container is strongest, the inward pressure exerted by the holder's thumb and fingers can be resisted substantially without causing the container 100 to lose its shape or integrity.

The comfort strips 20 can be any practical length or width, straight or tapered, and preferably have a textured surface 22. In a preferred embodiment, the comfort strips 20 are corrugated 22 or made of a corrugated material. Preferably, the comfort strips 20 extend from just slightly below the rim 15 to slightly above the base 13. In a preferred embodiment, due to manufacturing needs, the comfort strips extend from approximately ¼ inch below the rim 15 to approximately ¼ inch above the base 13.

In a preferred embodiment, the comfort strips 20 can be diametrically opposed to one another, to conform to the normal contours of the human hand. One embodiment of attaching the comfort strips 20 to the sidewall of the cylindrical member 10 can be by affixing, e.g., using polymer glues, adhesives, heat, etc., the comfort strips 20 to the cylindrical member 10 (FIG. 3B). Preferably, each comfort strip 20 can include a strip seam 25, which is attached directly to the cylindrical member 10, the rest of the comfort strip 20 hanging freely from and substantially unattached to the cylindrical member 10, i.e., it can be substantially cantilevered from the strip seam 25. Leaving the non-strip seam portion of the comfort strip 20 substantially unattached allows air to circulate behind the comfort strip 20, which provides for more efficient insulation.

In another embodiment, one of the comfort strips 20 can be formed integrally with the cylindrical member 10. As FIG. 3C illustrates diagrammatically one of the comfort strips 20 can be formed integrally at one end of the sidewall of the cylindrical member 10. Preferably, the cylindrical member 10 can be affixed to itself at a sidewall seam 27, which leaves the rest of the comfort strip 20 hanging freely from and substantially unattached to the cylindrical member 10, i.e., it is substantially cantilevered from the sidewall seam 27. Leaving the non-strip seam portion of the comfort strip 20 substantially unattached allows air to circulate behind the comfort strip 20, which provides for more efficient insulation. In this embodiment, the opposing comfort strip 20 can be attached to the cylindrical member 10, e.g., in a like manner as described above using a strip seam 25.

A dome-shaped cover or lid 30 (FIGS. 1 and 2A) seals the top 11 of the cylindrical member 10 when desired and, when not desired, the cover section 30 can be used as a coaster to protect underlying surfaces from moisture damage. To seal the top 11 of the cylindrical member 10, the rim 15 of the cylindrical member 10 is inserted in a cavity 18 in the peripheral rim channel section 34 of the cover 30 in a manner that is well known to those skilled in the art. With the top 11 covered, the container can be virtually leak-proof.

The dome-shaped cover 30 preferably can be symmetrical. Prior art lids rarely can support much more than their own weight, let alone one or more filled, stacked containers. Prior art lids typically provide a cover using a simple planar structure that provides little support. The structure of the lid of the present invention provides the structural advantages of an arch, which is the mainstay of polyhedral domes.

The dome-shaped cover or lid 30 of the present invention uses a structural arch to provide greater strength to the cover 30, which allows a user to stack one or more filled containers 100 on top of each other. A plurality of arched radial struts (i.e., arches) 35 radiates outward from the central hub 31 of the dome-shaped cover 30. The radial struts 35 originate about at the outer edge 32 of the central hub 31 and extend continuously to about the inner surface 33 of the peripheral curl section 34. Each radial strut 35 can include an elevated stacking portion 36, the outer ends of which form a ring 37. In one embodiment, the diameter of the ring 37 can be approximately the same as the diameter of the base 13 so that when either the dome-shaped cover 30 is used as a coaster, or at least one additional filled container 100 is stacked on top of a covered container 100, the cylindrical member 10 will rest snugly on the cover 30, with the elevated stacking ring 37 inserted snugly inside and in frictional contact with the base 13.

Between each pair of adjacent supporting radial struts 35 can be a substantially horizontal tabular hinged drinking region 40 that extends radially from its line of intersection 60 with the webbing section 38. Preferably, there can be about 4 to about 8 tabular hinged drinking regions 40 on a single cover 30. This hinged drinking region 40 can create a plurality of drink-through openings 45 when a vertical force is applied to invert it relative the dome-shaped structure of the cover 30. A webbing section 38, which is pitched slightly from the outer wall 32 of the central hub 31 to the inner surface 33 of the peripheral curl section 34, can be on both sides of the tabular hinged drinking region 40. The tabular hinged drinking region 40 can be connected to the webbing section 38 by substantially vertical sidewalls 46, 47 and an end wall 49.

The plurality of tabular hinged drinking regions 40 provides many advantages for the present invention over the prior art. First, the dome-shaped cover 30 can be secured onto the cylindrical member 10 without having to align a drink-through opening 45 with either of the comfort strips 20 of the container 100. Indeed, with multiple tabular hinged drinking regions 40 on a single cover 30, there can be substantial certainty that at least one of the tabular hinged drinking regions 40 aligns substantially with at least one of the comfort strips 20, which constitutes the optimal drinking mode.

Figure 1:
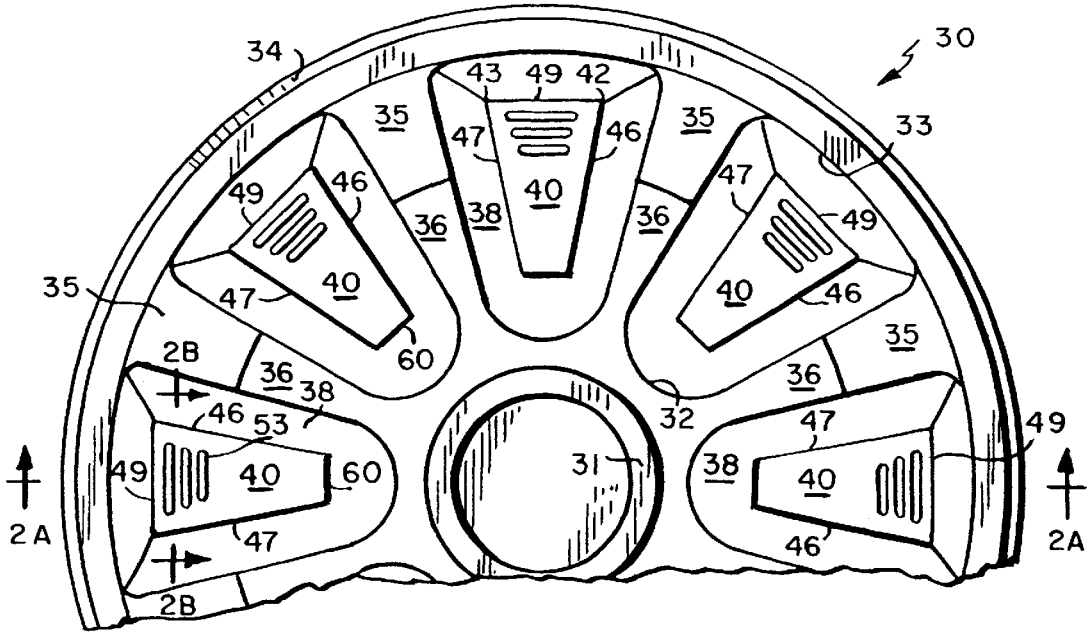
FIG. 1 is a diagrammatical illustration of a partial plan view of a dome-shaped drink-through lid in accord with one embodiment of the invention.

Tabular hinged drinking regions 40 can assume any practical shape, including without limitation a parallelogram, a rectangle, a triangle, a polygon, and an oval configuration with pointed ends, e.g., like a football, all of which shapes are within the scope of the disclosed invention. A parallelogram-like shape for the planar surface 40 is presently preferred, an exemplary embodiment of which is shown in FIGS. 1 and 4.

The primary criteria for the shape of the tabular hinged drinking region 40 is a functional one, i.e., when inverted, the shape must provide slits in the cover through which fluids can pass for drinking the contents of the container 100 while the cover 30 is positioned thereon. Preferably, the upper surface 41 of the tabular hinged drinking regions 40 can be slightly arched along its radial axis, more particularly, the upper surface 41 of the tabular hinged drinking region 40 can be slightly arched near the hinge 60, which can permit a relatively slight inversion of a tabular hinged drinking region 40 to substantially lock the depressed tabular hinged drinking region 40 in an open position. The mechanics of inverting the tabular hinged drinking region 40 to create at least one drink-through opening 45 will be discussed in greater detail below.

Figures 2A, 2B:
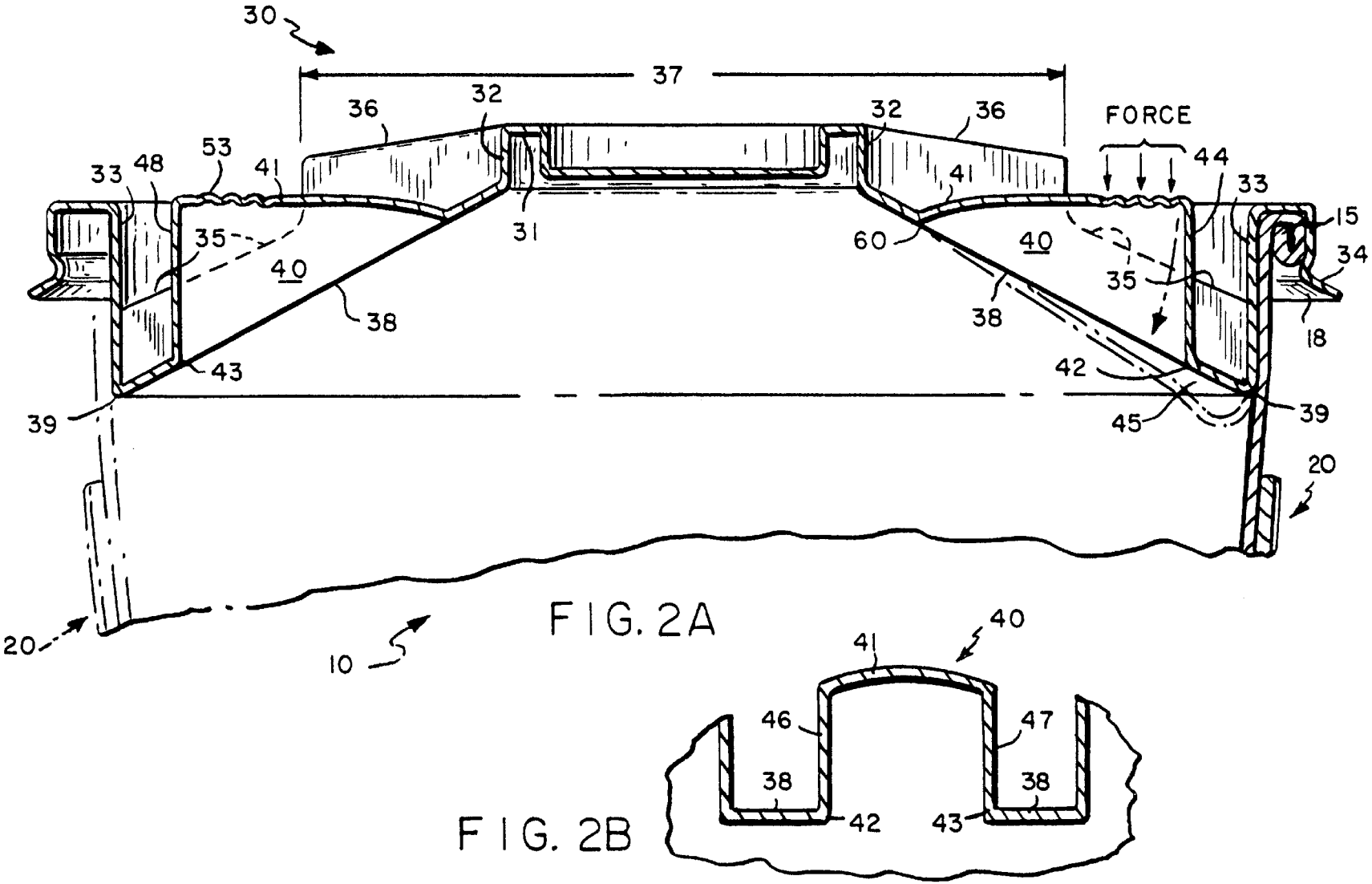
FIG. 2A is a diagrammatical illustration showing an elevation view of a dome-shaped drink-through lid on a container in accord with one embodiment of the invention.
FIG. 2B is a diagrammatical illustration taken along line 2B—2B of FIG. 1, showing a depressible hinged tabular region in cross-section.

For purposes of the disclosed invention, the tabular hinged drinking region 40 is not required to be planar. Indeed, FIG. 2B illustrates an exemplary embodiment of a tabular hinged drinking region 40 that is slightly rounded. It is only necessary that inversion of the tabular hinged drinking region 40 creates at least one drink-through opening 45.

Figure 4:
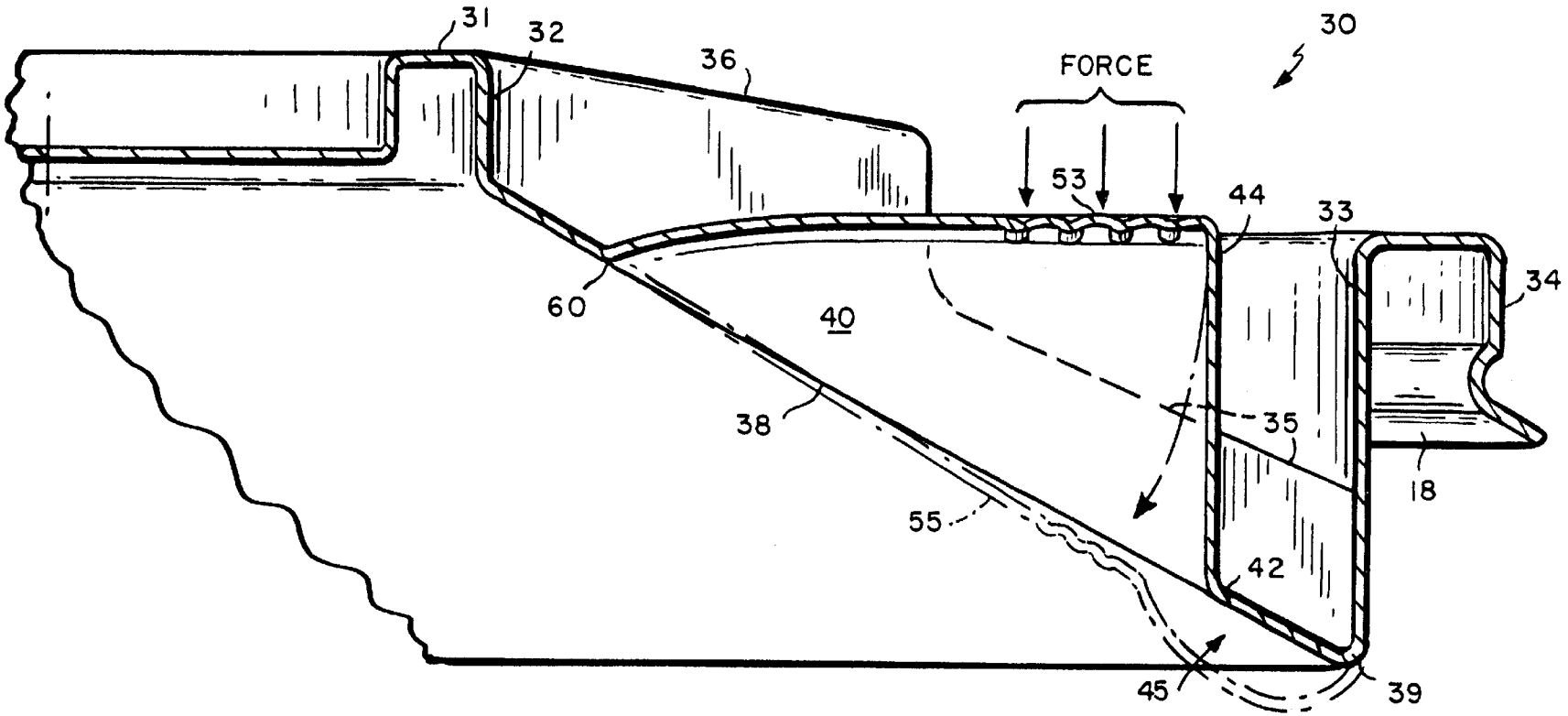
FIG. 4 is a diagrammatical illustration showing a partial elevation view of a depressible hinged tabular region of the lid.

The inversion of the tabular hinged drinking region 40 to provide a drink-through opening 45 is well known to those skilled in the art (FIGS. 2A and 4). When a vertical force is applied to the upper surface 41 of the tabular hinged drinking region 40, initially, the force is transferred to the corners 42, 43 at the point of intersection of the vertical sidewalls 46, 47, the end wall 49, and the webbing section 38, which are shown in the preferred embodiment as a lower left corner 42 and a lower right corner 43. The pitched webbing section 38 and the vertical sidewalls 46, 47, typically, can be less thick than the rest of the dome-shaped cover 30, e.g., because of an aggressive draw ratio, therefore can be inherently weaker. Moreover, molded corners 42, 43 provide a natural point of weakness in the cover 30. Consequently, as a vertical force is applied, e.g., by an index finger, to the upper surface 41 of a tabular hinged drinking region 40, the force progressively ruptures the pitched webbing section 38 at the lower left corner 42 and lower right corner 43, creating a pair of small openings thereat.

Figure 5:
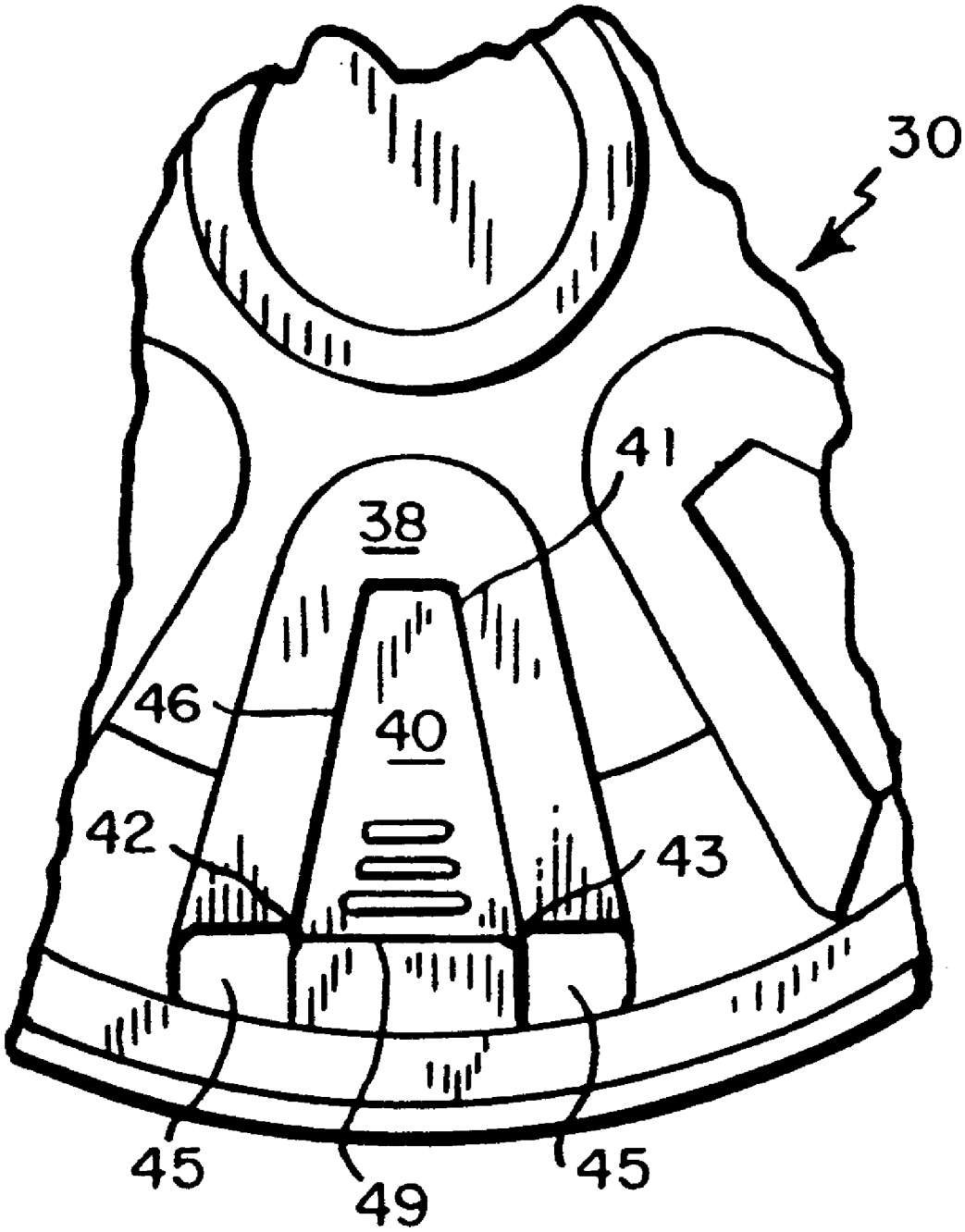
FIG. 5 is a diagrammatical illustration of an embodiment of a plurality of flow-through openings in a tabular hinged drinking region.

As force continues to be applied to the upper surface 41 of the tabular hinged drinking region 40, the small openings can propagate further across the webbing section 38 and up the corners of vertical walls 46, 47 to create much larger, drink-through openings 45. See FIG. 5. Indeed, the small openings can propagate upwards along formed lines 44, 48 that occur, respectively, where the left sidewall 46 and the end wall 49 intersect and where the right sidewall 47 and the end wall 49 intersect. As the small openings propagate along the formed lines 44, 48, the small openings also can propagate through the pitched webbing section 38, stopping approximately at the base 39 of the inner surface 33 of the peripheral curl section 34, which maintains the integrity of the peripheral curl section 34. When the tabular hinged drinking region 40 has been fully depressed, typically, at least two drink-through openings 45 can be created. Moreover, a substantial portion of the upper surface 41 of the tabular hinged drinking region 40 lies below the pitched webbing section 38.

The depressed surface section 55 preferably can be self-locking, i.e., the depressed surface section 55 can be locked into place once depressed. Self-locking can be provided by slightly arching the upper surface 41 near the hinge 60. Furthermore, the depressed surface section 55 can serve as a splashguard. Also, fluid that happens to be on the cover 30 can flow back into the cylindrical member 10 via the pitched webbing section 38, which, in design, pitches toward the drink-through openings 45.

Unlike depressible, drink-through openings of the prior art, the upper surface 41 of the tabular hinged drinking region 40 in this invention, when depressed, does not progress in a generally parallel direction; rather, the upper surface 41 of the tabular hinged drinking region 40 rotates along a generally circular or spiral path about a hinge 60.

Any manner of decoration can be added to the cover section to identify the contents, a trademark, or other logo. Furthermore, the plurality of tabular hinged drinking regions 40 also can be provided with tactile elements 53.

The invention has been described in detail. However, it is to be appreciated that those skilled in the art may make improvements, changes, and/or additions within the scope of the invention. For example, the hub section 31 can have a raised central surface in place of the depressed surface. A logo can be conveniently formed or printed in the central section of the hub 31. A fewer number of tabular hinged drinking regions 40 can be used for forming the drink through openings 45.

What is claimed is:

1. A lid for a container comprising an open end, a closed end and a peripheral sidewall therebetween, the peripheral sidewall having a rolled rim at the edge thereof adjacent the open end of the container, the lid comprising a dome-shaped structure having a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one flow-through opening in the tabular hinged drinking region of the lid;

wherein the tabular hinged drinking region comprises:

a raised area extending radially from the central region toward the peripheral rim curl, the raised area forming a hinge with dome-shaped lid, radially vertical side walls on opposing sides of the raised area, the walls having a height that increases with the radius from the hinge, and a vertical end wall that connects a raised end of the raised area with the dome-shaped lid, wherein the raised area is slightly arched near the hinge to be self-locking when the raised area is depressed into the container.

2. A lid for a container comprising an open end, a closed end and a peripheral sidewall therebetween, the peripheral sidewall having a rolled rim at the edge thereof adjacent the open end of the container, the lid comprising a dome-shaped structure having a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one flow-through opening in the tabular hinged drinking region of the lid, and further wherein a tabular hinged drinking region is located between each pair of adjacent arched struts.

3. The lid for a container according to claim 2 wherein the lid comprises from about 4 to 8 tabular hinged drinking regions.

4. A combination of a container and a cover for closing the container and adapted for providing openings for drinking fluid passing therethrough, the container comprising:

an open end;

a closed end; and a peripheral sidewall between the open and closed ends, the peripheral sidewall having a rolled rim at the edge thereof adjacent the open end of the container;

the lid comprising a dome-shaped structure having:

a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one flow-through opening in the tabular hinged drinking region of the lid;

wherein the container further comprises a pair of insulating comfort strips, which provides insulation from an extreme temperature of the liquid or semi-liquids contained in the container; and further wherein the pair of insulating comfort strip is affixed to the peripheral sidewall along a seam provided therefor.

5. The combination of claim 4 wherein at least one insulating comfort strip is adhesively affixed to the peripheral sidewall along a strip seam.

6. The combination of claim 4 wherein one of the insulating comfort strips is adhesively affixed integrally to the peripheral sidewall along a sidewall seam.

7. A combination of a container and a cover for closing the container and adapted for providing openings for drinking fluid passing therethrough, the container comprising:

an open end;

a closed end; and a peripheral sidewall between the open and closed ends, the peripheral sidewall having a rolled rim at the edge thereof adjacent the open end of the container;

the lid comprising a dome-shaped structure having:

a peripheral rim curl for locking to the rolled rim of the container to close the open end;

a central region;

a plurality of arched struts extending radially between the central region and the peripheral rim curl; and at least one tabular hinged drinking region; wherein the tabular hinged drinking region comprises:

a raised area extending radially from the central region toward the peripheral rim curl, the raised area forming a hinge with dome-shaped lid, radially vertical side walls on opposing sides of the raised area, the walls having a height that increases with the radius from the hinge, and a vertical end wall that connects a raised end of the raised area with the dome-shaped lid, wherein the tabular hinged drinking region is structured and arranged to be depressed into the container, thereby providing at least one flow-through opening in the tabular hinged drinking region of the lid, and further wherein the raised area is slightly arched near the hinge to be self-locking when the raised area is depressed into the container.

8. A combination of a container and a cover for closing the container and adapted for providing openings for drinking fluid passing therethrough, the container comprising:

an open end;

a closed end; and a peripheral sidewall between the open and closed ends, the peripheral sidewall having a rolled rim at the edge thereof adjacent the open end of the container;

the lid comprising a dome-shaped structure having:

a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one flow-through opening in the tabular hinged drinking region of the lid, wherein a tabular hinged drinking region is located between each pair of adjacent arched struts.

9. A lid for a container comprising an open end, a closed end and a peripheral sidewall therebetween, the peripheral sidewall having a rolled rim at the edge thereof adjacent the open end of the container, the lid comprising a dome-shaped structure having a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one non-resealable, flow-through opening in the tabular hinged drinking region of the lid.

10. The lid for a container according to claim 9 comprising a plurality of tabular hinged drinking regions.

11. The lid for a container according to claim 9 wherein two flow-through openings are provided in the tabular hinged drinking region of the lid.

12. The lid for a container according to claim 9 wherein the lid is structured and arranged to provide sufficient strength to hold the weight of at least one filled container without buckling.

13. The lid for a container according to claim 9 wherein a tabular hinged drinking region is located between each pair of adjacent arched struts.

14. The lid for a container according to claim 13 wherein the lid comprises from about 4 to 8 tabular hinged drinking regions.

15. The lid for a container according to claim 9 wherein the tabular hinged drinking region comprises:

a raised area extending radially from the central region toward the peripheral rim curl, the raised area forming a hinge with dome-shaped lid, radially vertical side walls on opposing sides of the raised area, the walls having a height that increases with the radius from the hinge, and a vertical end wall that connects a raised end of the raised area with the dome-shaped lid.

16. The lid of a container according to claim 15 wherein the raised area is substantially planar.

17. The lid of a container according to claim 15 wherein the raised area is rounded in a direction tangential to the central region.

18. The lid of a container according to claim 15, wherein the raised area is slightly arched near the hinge to be self-locking when the raised area is depressed into the container.

19. A combination of a container and a cover for closing the container and adapted for providing non-resealable openings for drinking fluid passing therethrough, the container comprising:

an open end;

a closed end; and a peripheral sidewall between the open and closed ends, the peripheral sidewall having a rolled rim at the edge thereof adjacent the open end of the container;

the lid comprising a dome-shaped structure having:

a peripheral rim curl for locking to the rolled rim of the container to close the open end;

a central region;

a plurality of arched struts extending radially between the central region and the peripheral rim curl; and at least one tabular hinged drinking region;

wherein the tabular hinged drinking region is structured and arranged to be depressed into the container, thereby providing at least one flow-through opening in the tabular hinged drinking region of the lid.

20. The combination of claim 19 wherein the container further comprises a pair of insulating comfort strips, which provides mass and strength to the container.

21. The combination of claim 19 wherein the lid comprises a plurality of tabular hinged drinking regions.

22. The combination of claim 19 wherein two flow-through openings are provided in the tabular hinged drinking region of the lid.

23. The combination of claim 19 wherein the lid is structured and arranged to provide sufficient strength to hold the weight of at least one filled container without buckling.

24. The combination of claim 19 wherein a tabular hinged drinking region is located between each pair for adjacent arched struts.

25. The combination of claim 19 wherein the lid comprises from about 4 to 8 tabular hinged drinking regions.

26. The combination of claim 19 wherein the container further comprises a pair of insulating comfort strips, which provides insulation from an extreme temperature of the liquid or semi-liquids contained in the container.

27. The combination of claim 26 wherein the pair of insulating comfort strips is diametrically opposed to one another.

28. The combination of claim 26 wherein the insulating comfort strips have a textured surface to provide a tactile feedback.

29. The combination of claim 26 wherein the pair of insulating comfort strip is affixed to the peripheral sidewall along a seam provided therefor.

30. The combination of claim 29 wherein at least one insulating comfort strip is adhesively affixed to the peripheral sidewall along a strip seam.

31. The combination of claim 29 wherein one of the insulating comfort strips is adhesively affixed integrally to the peripheral sidewall along a sidewall seam.

32. The combination of claim 19 wherein the tabular hinged drinking region comprises:

a raised area extending radially from the central region toward the peripheral rim curl, the raised area forming a hinge with dome-shaped lid, radially vertical side walls on opposing sides of the raised area, the walls having a height that increases with the radius from the hinge, and a vertical end wall that connects a raised end of the raised area with the dome-shaped lid.

33. The combination of claim 32 wherein the raised area is substantially planar.

34. The combination of claim 32 wherein the raised area is rounded in a direction tangential to the central region.

35. The combination of claim 32 wherein the raised area is slightly arched near the hinge to be self-locking when the raised area is depressed into the container.

* * * * *